United States Patent [19]

Washchynsky et al.

[11] Patent Number: 4,878,427

[45] Date of Patent: Nov. 7, 1989

[54] PRINTING STATION WITH TOOLLESS CHANGEABLE PLATE CYLINDER

[75] Inventors: Bohdan Washchynsky, Boca Raton; Vladimir J. Fisher, Coral Springs, both of Fla.

[73] Assignee: Webtron Corporation, Ft. Lauderdale, Fla.

[21] Appl. No.: 76,181

[22] Filed: Jul. 21, 1987

[51] Int. Cl.[4] ..... B41F 5/24; B41F 13/44

[52] U.S. Cl. ..... 101/219

[58] Field of Search ..... 101/174, 351, 352, 178, 101/181, 182, 183, 184, 216, 219, 247, 248, 350, 228

[56] References Cited

U.S. PATENT DOCUMENTS

| | | | |
|---|---|---|---|
| 2,893,310 | 7/1959 | Johnson | 101/182 |
| 3,041,967 | 7/1962 | Nystrand | 101/182 |
| 3,131,631 | 5/1964 | Haskin, Jr. | 101/247 |
| 3,139,025 | 6/1964 | Chambon | 101/182 X |
| 3,691,956 | 9/1972 | James et al. | 101/247 |
| 3,791,294 | 2/1974 | Skelding et al. | 101/181 X |
| 4,138,944 | 2/1979 | Biggar, III | 101/247 |
| 4,240,346 | 12/1980 | Landis et al. | 101/351 X |

*Primary Examiner*—Clifford D. Crowder

*Attorney, Agent, or Firm*—Hill, Van Santen, Steadman & Simpson

[57] ABSTRACT

A printing station for use in a flexographic printing press. The printing station has a frame to which is attached supports for holding a doctor roll, an anilox roll and an impression roll. Adjustable mechanisms are provided for adjusting these rolls such that a plate cylinder may be removed and reinserted, without the use of tools, and without any need to readjust the adjustable mechanisms. The doctor roll and the anilox roll may also be removed without the use of tools. Two printing stations may be used to print alternately while a web having substrates moves continuously through the stations. This is achieved without significant waste because of the ability to quickly change plate cylinders without readjustment of the printing station.

30 Claims, 16 Drawing Sheets

PRINTING STATION WITH TOOLLESS CHANGEABLE PLATE CYLINDER

BACKGROUND OF THE INVENTION

This invention relates in general to flexography and, in particular, to an apparatus for quickly removing and interchanging rollers and cylinders in a flexographic printing system.

Flexography prints from a raised image and its print plates are generally made of flexible, elastomeric materials. The section of the plate carrying the ink is the raised portion obtained by removing and lowering the nonprinting areas through cutting, molding, etching, dissolving or washing them away.

Flexographic inks are traditionally thin, highly fluid and rapid-drying; although paste-type inks may also be used. These inks are formulated from resins which are both solvent and water reducible.

Plate materials include various moldable, natural and synthetic rubber compounds and photo-polymer materials. The plates are generally affixed to a plate cylinder with double-sided sticky tape.

Press frame designs include central impression, in-line and stack types. The central impression uses one common impression cylinder around which several printing stations are placed. The in-line design involves a tandem series of printing stations placed in a row. The stack version has individual printing stations mounted on frames one above the other in two "stacks" generally one to four on each side of a vertical frame.

The typical flexographic printing station or roller grouping from ink reservoir to substrate impression cylinder generally includes four rollers. A doctor roll turning in ink delivers ink to a steel or ceramic anilox roll, a plate cylinder and an impression cylinder.

Flexography is unique among other printing processes in that it was developed primarily for the printing of packaging materials. Since packaging materials are mostly used in roll form for feeding into form and fill, overwrapping, bag making and other continuous web processing machines, it follows that most flexographic printing is done roll to roll. Flexography has grown today beyond the printing of packaging materials and now includes a wide variety of other products.

In its simplest and most common form, the flexographic printing system consists of four basic parts: doctor roll, anilox roll, plate cylinder, and impression cylinder.

The doctor roll is generally a rubber-covered roll of either natural or synthetic rubber. It is positioned to rotate in a reservoir of thin ink. Its main purpose is to pick up and deliver a relatively heavy flow from the reservoir to the anilox roll. The anilox roll, is usually a metal or ceramic coated roll engraved over its entire surface with tiny cells numbering from 80 to over 500 per lineal inch. The purpose of the anilox roll is to supply a controlled, metered, fine film of ink to the printing plates affixed to the plate cylinder. For this reason, the doctor and anilox rolls are set to rotate under considerable pressure against each other in a wringer-like action to squeeze away excess ink from the surface of the anilox roll, leaving ink primarily in the engraved cells. The anilox roll in turn continues to rotate and ink is deposited on the raised image area of the printing plate on the plate cylinder.

The contact pressure of the anilox roll to the printing plate is set to be as light as practical in order not to over ink or cause ink to be pressed down on the shoulders of the raised image area of the plates. The anilox roll must travel at the same surface speed as the plate cylinder and is geared accordingly.

Variations of the common flexigraphic two-roll inking system described above are possible. In addition to the ink metering action between the doctor and anilox rolls, it is possible to add a "doctor blade" to shave the surface of the anilox roll just beyond the ink metering location. Its purpose is to increase the removal of surface ink and insure a more controlled inking of the printing plates. The doctor blade is usually made of spring steel or a phenolic material.

Other variations eliminate the rubber doctor roll and position the engraved anilox roll in its place. An ink applicator delivers a heavy flow of ink to the anilox roll pumped from a remote tank. The doctor blade is positioned just beyond the applicator. The ink reservoir pan serves as a catch basin funnelling ink back to the remote ink tank.

The plate cylinder is generally a steel or aluminium cylinder placed between the anilox roll and the impression roll. Printing plates are adhered to it through the use of a double-sided adhesive tape. The total plate cylinder diameter including adhesive tape and printing plate must equal the pitch diameter of the driving gear. For this reason, the bare plate cylinder for a given printing repeat length must be reduced in diameter or "undercut" to accomodate the tape and printing plate.

The anilox roll then transfers a finely metered film of ink to the raised surface of the plate, which in turn transfers the ink to the surface of the substrate or web. The impression roll is a smooth polished metal cylinder which serves to back up and support the substrate as it comes in contact with the printing plate. The surface speed of the impression cylinder with substrate must be identical to that of the plate cylinder and anilox roll. Otherwise, slurring, halos, smeared printing and reduced plate life will result.

Flexographic web-fed presses, generally consist of four basic sections, with a multiple of variations including adaptability to many in-line operations for specific purposes: (1) Unwind and infeed section; (2) printing section; (3) drying section; and (4) outfeed and rewind section, or subsequent in-line operation.

The roll of stock to be printed must be held under control so that the web can unwind into the press as needed, in proper alignment and under proper tension to prevent slack and wrinkles. The tension should be not so great that it will cause web stretching or breakage. In simplest form, this all may be accomplished by holding the roll in chucks on a steel shaft mounted in plain bearings with a manually controlled hand brake for tension control and a threaded rod and hand wheel for lateral adjustment. In prior art systems, almost continuous monitoring of the system by the operator is required.

An effective unwind and infeed system may include some or all of the following: (a) Multiple unwind positions; (b) rotating turrets to faciliate reloading; (c) Semi automatic chucking; (d) precision bearings; (e) automatic side-guide control; (f) automatic tension control with tension sensing devices; (g) driven infeed rolls; and (h) automatic roll splicing.

An unwind section may also include a nest of internally heated, steel rolls, or the rolls used for infeed tension control may be heated. The purpose for this is to "open" the surface of heavily glazed or "tight" papers by preheating, thus, making the surface more receptive to the ink. Preheating in this manner is also beneficial with some plastic materials, making them lay out flatter which reduces their tendency to wrinkle.

A single-color station comprised of the doctor roll, anilox roll, plate cylinder and impression roll is sufficient to constitute a printing station. However, the vast majority of presses are multi-color, with from two to eight printing stations in the printing section.

Some presses have their multiple units arranged in a horizontal row, each standing on the floor, similar to rotogravure, and are called "in-line" presses. Quite common in flexography is the "stack" type, with two to four colors arranged one above the other in the frame. A third type is the central impression press, where, like rotary letterpress, the color units are arranged in sequence around a common impression roll.

The drying section usually includes between-color drying capacity in order to print color-on-color, plus an after-dryer to remove the remaining solvent before winding into a roll. The most common method of drying is high velocity, heated air. There are several other methods in use, some of which require specially formulated inks. They include electron beam curing, electric infrared, ultra-violet and dielectric systems.

In prior art flexographic printing systems the doctor roll, the anilox roll, the plate cylinder and the impression roll are all securely held in place by bolts or other types of fasteners. In order to change the plate cylinder or other rolls a significant amount of time is required, for example, a half hour or more. In addition, the web must usually be stopped. Accelerations due to stopping and starting the web results in wastage of the web material. Furthermore, the cylinder and rollers must be readjusted since their relative positions are extremely critical. This has posed a severe problem in the prior art systems when "short run" printing jobs are requested. Many times it is simply uneconomical to perform "short run" printing jobs due to the wastage.

The present invention overcomes these drawbacks in the prior art.

SUMMARY OF THE INVENTION

This invention involves a printing station for use in a flexographic printing press. The printing station has a frame to which is attached supports for holding a doctor roll, an anilox roll and an impression roll. Adjustable mechanisms are provided for adjusting these rolls such that a plate cylinder may be removed and reinserted, without the use of tools, and without any need to readjust the adjustable mechanisms. The doctor roll and the anilox roll may also be removed without the use of tools. Two printing stations may be used to print alternately while a web having substrates moves continuously through the stations. This is achieved without significant waste because of the ability to quickly change plate cylinders without readjustment of the printing station.

BRIEF DESCRIPTION OF THE DRAWINGS

The features of the present invention which are believed to be novel, are set forth with particularly in the appended claims. The invention, together with further objects and advantages, may best be understood by reference to the following description taken in conjunction with the accompanying drawings, in the several Figures in which like reference numerals identify like elements, and in which:

DESCRIPTION OF THE PREFERRED EMBODIMENT

Figure 1:
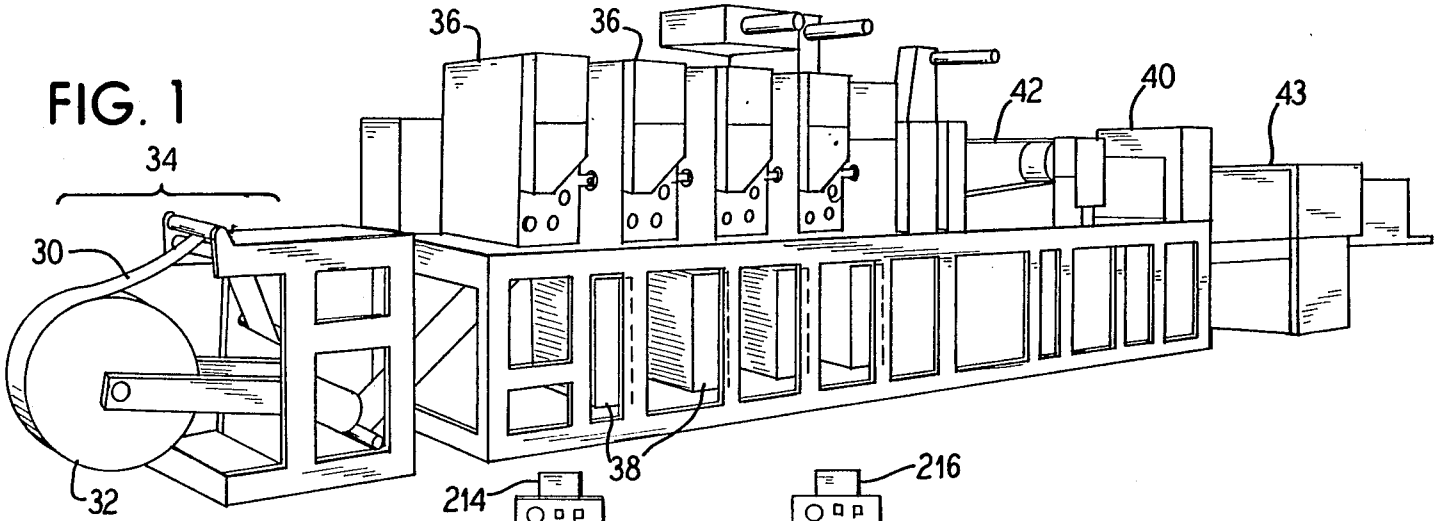
FIG. 1 is a schematic perspective depiction of an in-line flexographic printing press utilizing the present invention.

The present invention has general applicability, but is most advantageously utilized in an in-line flexographic printing press of the type depicted in FIG. 1.

As is known in the art of flexography, various types of substrates may be utilized for printing upon. Such foundation materials on the surface of which a substance may be deposited for the purpose, such as printing, coating, and various other applications is the substrate material. This material is generally supplied on large rolls and as it moves through the press as referred to as a web, that is, the paper, foil, film or other flexible material. From the roll it moves through the machine in the process of being formed, or in the process of being converted, printed, etc.

As shown in FIG. 1, the web 30 is taken from a supply roll 32 which is mounted in an unwind and in-fed section 34. The web 30 then proceeds through a number of printing stations 36 each of which deposits a different color upon the web, in the process of printing full color pictures. Various other types of printing processes, as well as other conversions to the web, are known in the art of flexography. Typically each of the printing stations 36 has a drying section 38 associated with it. Various other stations may be utilized with the flexographic press, such as a dye cutting station 40, a laminating station 42, etc. Finally, an outfeed and rewind section 43 is utilized for the finished product. Alternatively, a mechanism for cutting the web into sheets may also be utilized in which case individual sheets are then stacked at the output of the press.

Figure 2:
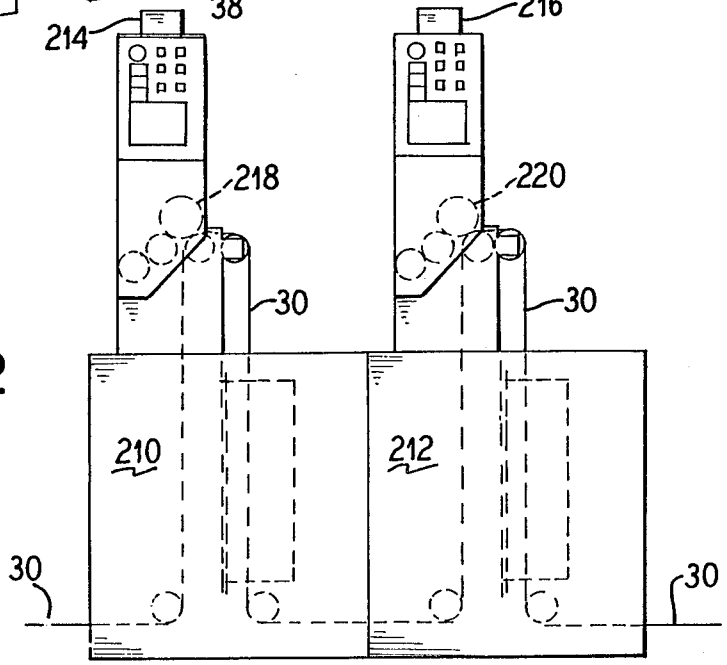
FIG. 2 is a perspective view of two printing stations for use in the FIG. 1 press.

As shown in FIG. 2, utilization of the present invention allows for two printing stations to be operated alternately. This provides an unique advantage in that the web may continuously move through both printing stations while the printing stations alternate in printing. As will be explained, the present invention allows for the quick changing of a plate cylinder in a printing station so that as one printing station is operating, the second printing station may be prepared for operation when the first printing station is finished. In the prior art, this was not possible due to the long time period needed to change plate cylinders and also for readjusting the settings of the cylinders and rollers in the printing station.

Figure 3:
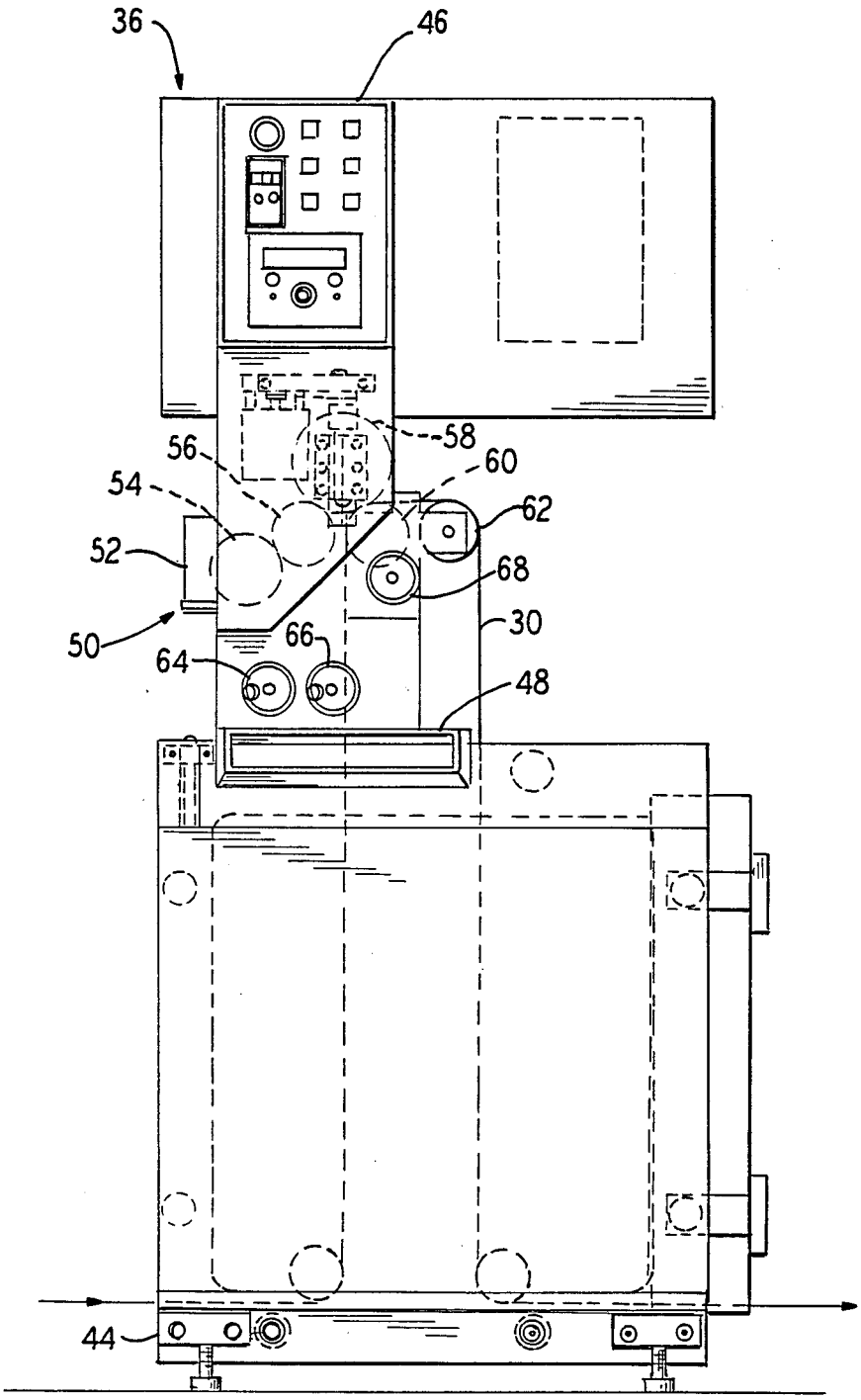
FIG. 3 is a front view of a printing station.
Figure 4:
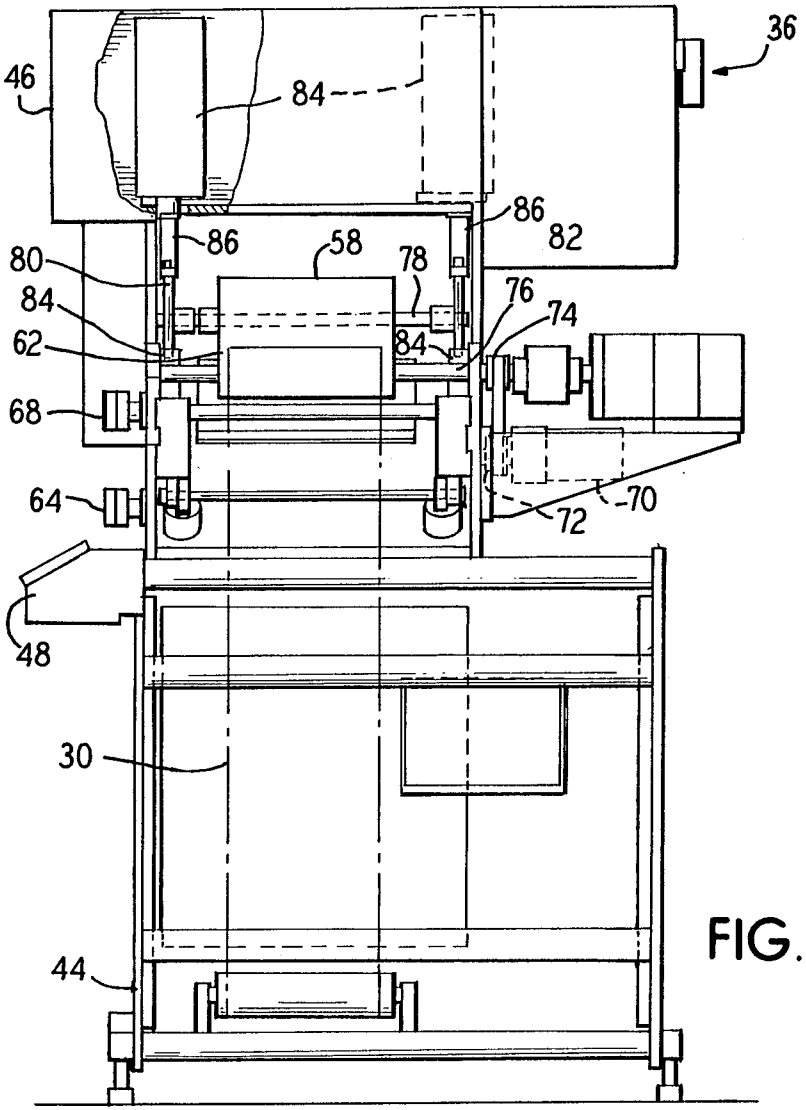
FIG. 4 is a side view of the FIG. 3 printing station.

FIGS. 3 and 4 are views of a printing station 36 which is utilized to apply, for example, one color to the web. The printing station 36 typically has a frame 44 which is designed to be securely bolted to the next station adjacent to it. Attached to the frame 44 is an electrical control panel 46 which contains the appropriate controls for the printing station 36. In addition, an instrument panel 48 is provided which is utilized to send signals and control the entire press. Typically, the instrument panels 48 of each of the printing stations are interconnected and the function of the various controls are thereby duplicated. This allows an operator to control the press from any one of the printing stations 36.

As is known in the art of flexography, an ink fountain sub-assembly 50 has an ink pan 52 which supplies ink to a doctor roll 54. The doctor roll 54 picks up the ink or other coating material from the ink pan 52 and applies it to the anilox roll 56. The anilox roll 56 is an engraved steel or ceramic roll which is used to meter a controlled film of ink. This volume of ink is determined by the number of cells per linear inch which are engraved on the anilox roll 56. Typically, the anilox roll 56 is essentially a pattern of dots which transfers ink in a dot-like pattern to the plate cylinder 58. The plate cylinder 58 holds the plate which is used to retain the ink from the anilox roll 56 for printing on the web 30. The web 30 travels between the plate cylinder 58 an the impression roll 60 where the ink is transferred from the plate on the plate cylinder 58 to the web 30. Thereafter, an idler roll 62 guides the web 30 to other idler rolls and onto the next printing station.

As is known in the art of flexography, the pressure and alignment between the various rolls and cylinder in the printing station is critical to the quality of printing. The rolls are adjusted for proper pressure and alignment by means of adjusting mechanisms 64, 66 and 68.

The present invention provides for a quick removable and interchanging of the plate cylinder 58 without the need to readjust the press by means of the adjustment mechanisms 64, 66 and 68. In addition, the present invention allows for the plate cylinder 58 to be sufficiently lifted-off the web 30 for nonprinting of the web 30 while the web 30 moves through the printing station. This is also done without any need for readjustment of the printing station rolls.

As is known in the art, the doctor roll 54, the anilox roll 56, the plate cylinder 58 and the impression roll 60 are all synchronized so that they revolve without undesired slipping between the rolls and cylinder. In the present embodiment, motor 70 drives a shaft 72 which in turn is connected to various gears, as well as, to a timing belt 74 to another shaft 76, and thereby synchronizes and drives the rolls and cylinder. More specifically, the plate cylinder 58 is geared to the impression roll 60 and the anilox roll 56 is keyed to the shaft 76 which is driven by the timing belt 74. The doctor roll 54 is geared to the anilox roll 56. Obviously various other types of mechanisms may be utilized to drive and synchronize the rolls and cylinder.

As can be seen in FIG. 4, the plate cylinder 58 is mounted on a shaft 78 which at its ends, contains discs 80 and 82. Air cylinders 84 provide a predetermined force through pistons 86 to the end disc 80 and end disc 82 of the plate cylinder 58. The end disc 80 and end disc 82 also contact bearers generally designated as 84 in FIG. 4.

Figure 5A:
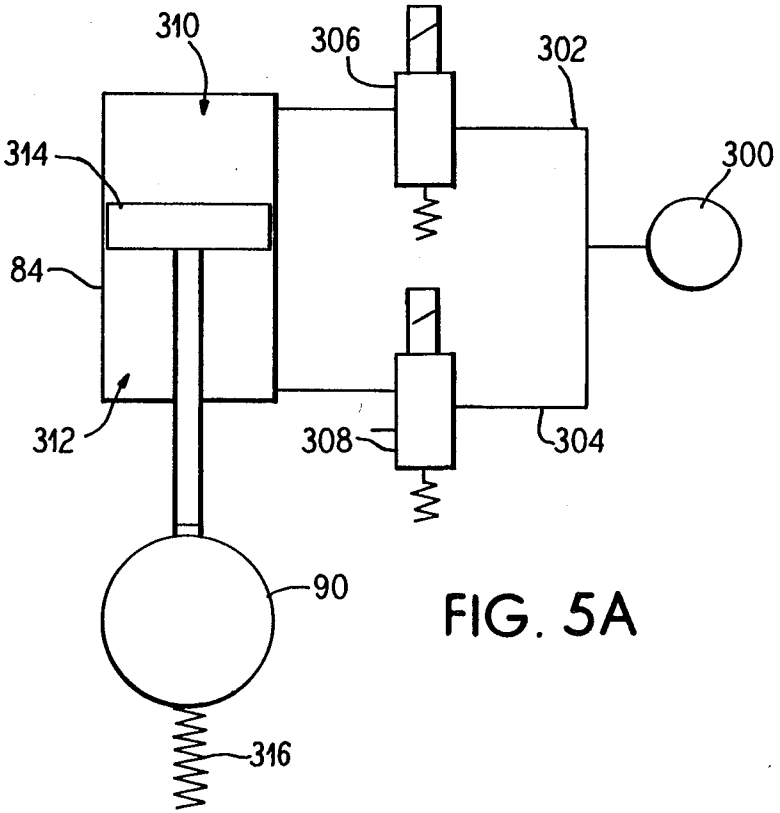
FIG. 5A is a schematic depiction of the differential pressure system used in the printing station.
Figure 5:
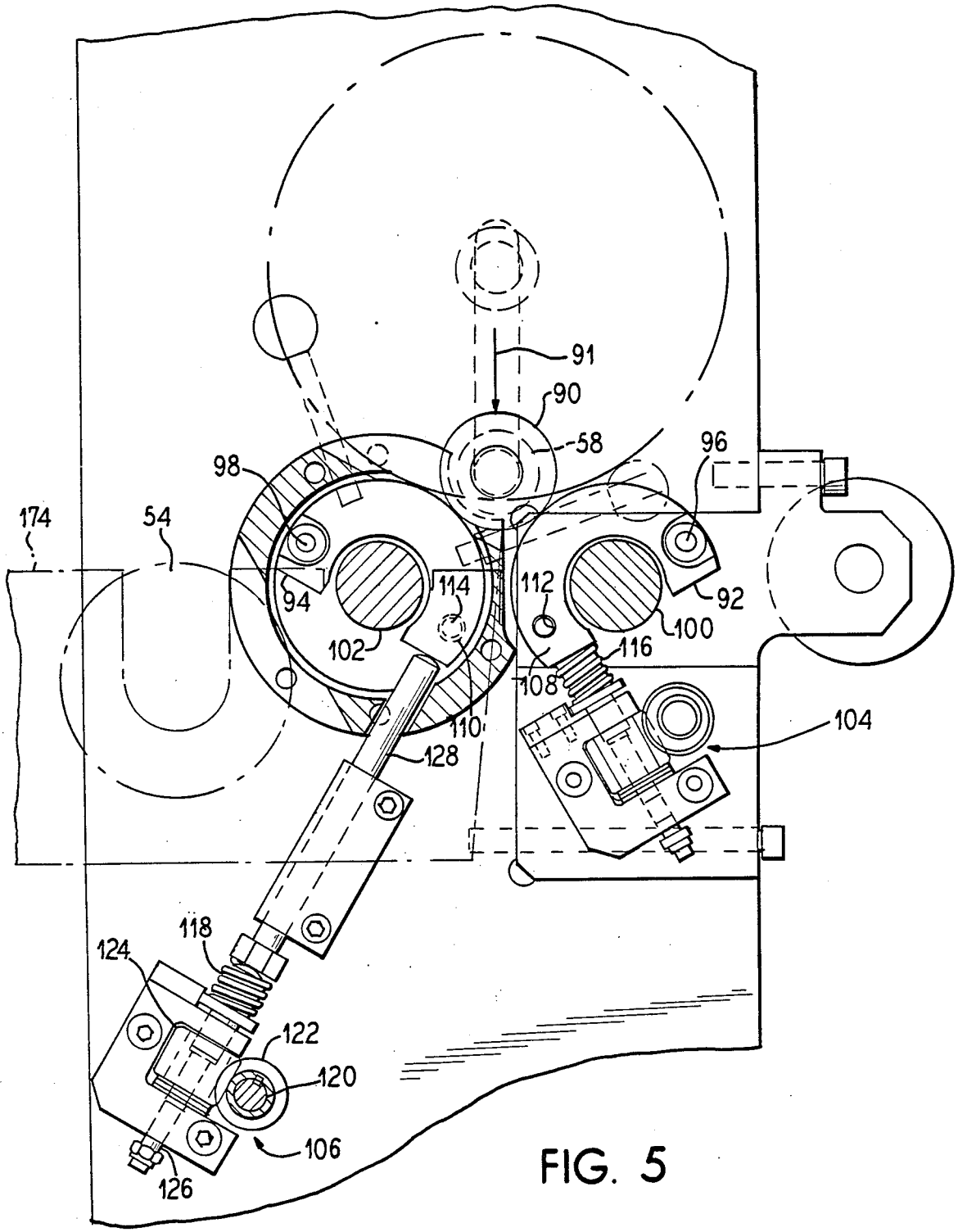
FIG. 5 is an end view of the rollers and their corresponding adjustment mechanisms.
Figure 6:
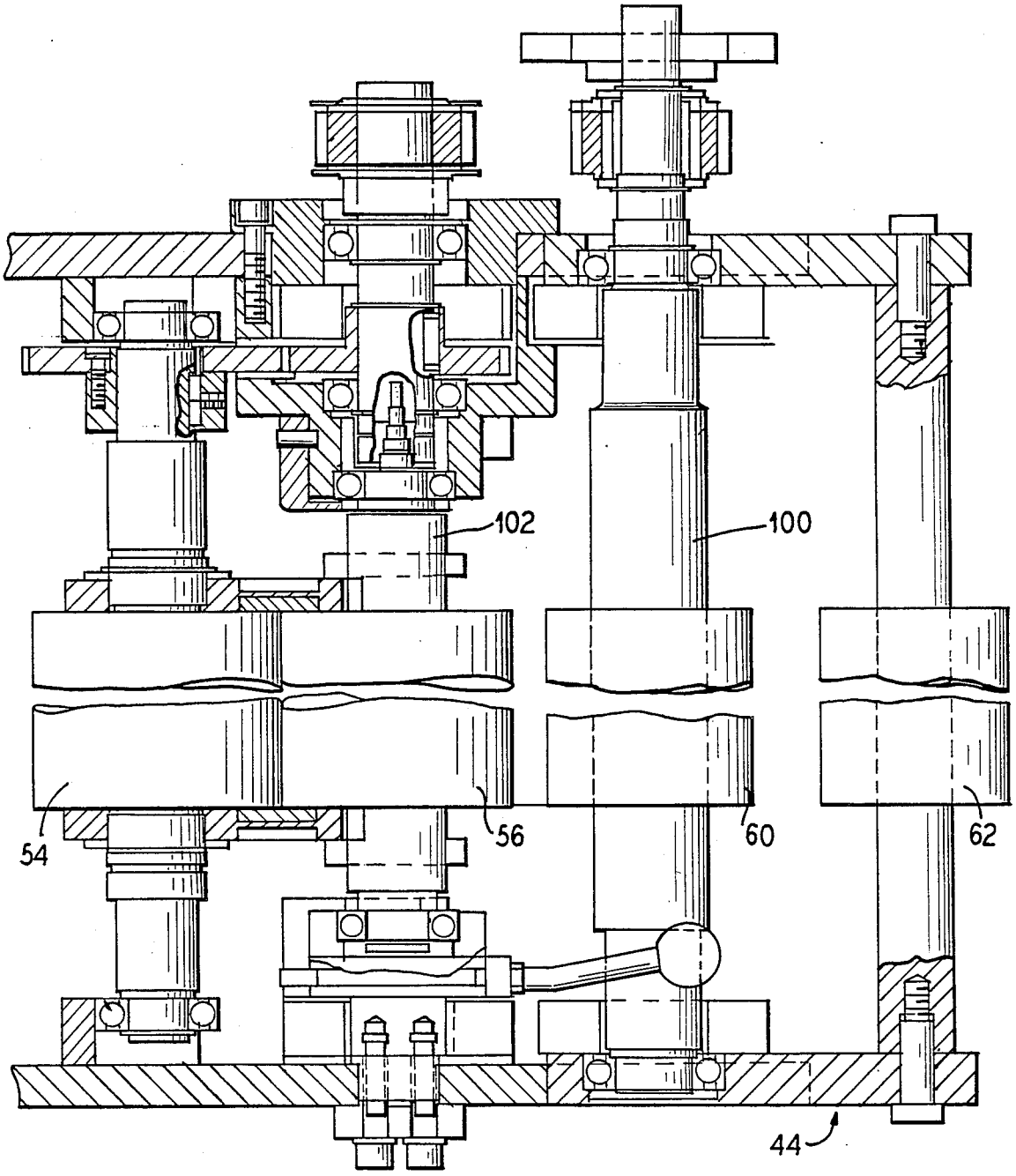
FIG. 6 is a cross-sectional top view of the adjustment mechanisms used for the rollers and cylinders in the printing station.

FIG. 5 shows a more detailed end view of the rolls and cylinder assembly and their corresponding adjustment mechanisms. FIG. 6 also depicts a top cross-sectional view of this assembly. As can be seen in FIGS. 5 and 6, the plate cylinder 58 has an end bearer disc 90 (end bearer disc 90 is the same element as end discs 80 and 82 shown in FIG. 4) which contacts the impression bearer 92 and the anilox bearer 94. As previously shown with regards to FIG. 4, the air cylinder 84 through piston 86 applies force to the top of the bearer disc 90 and is depicted as an arrow 91 in FIG. 5. It can be appreciated that different size plate cylinders can be utilized with the present invention.

As shown in FIG. 5, the bearers 92 and 94 are substantially U-shaped and pivoted at one end, 96 and 98, respectively. Furthermore, the bearers 92 and 94 are positioned about the impression roll axis 100 and the anilox roll axis 102, respectively. Adjusting mechanisms 104 and 106 cause the bearers 92 and 94 to move and pivot about their respective pivot points. This movement effects proper adjustment by means of the bearer disc 90 between the plate cylinder 58 and the impression roll 60 and between the plate cylinder 58 and the anilox roll 56. It should be noted that a corresponding set of adjustment mechanisms, bearers and bearer disc are located on the other end of the rolls and cylinder. On the ends of the bearer 92 and 94, opposite their pivot points are apertures 108 and 110 within which stationary pins 112 and 114 are positioned. The resulting gap between the apertures and their corresponding pins determines the amount of the adjustment which is allowed to the bearer. As is well known in flexography, the adjusting amounts are quite critical and only minute distances need be utilized to achieve the proper adjustment.

When the force provided by the air cylinders 84 is removed from the bearer disc 90, springs 116 and 118 on the adjusting mechanisms 104 and 106 cause both bearers 92 and 94 to move upward until the walls the apertures 108 and 110 engage the pins 112 and 114, thereby prohibiting any further upward movement. This effectively causes the plate cylinder 58 to lift off of the anilox roll 56 and the impression roll 60 sufficient to allow these rolls to continue to rotate with the web moving past, without causing printing by the plate cylinder 58. Each of the adjusting mechanisms 104 and 106 has a shaft 120 connected to a worm gear 122 which engages gear 124. Shaft 126 is keyed to the gear 124 allowing axial movement. The shaft 126 extends through the springs 116 and 118 which thereby engages the bearer 92 or 94. As shown, for adjusting mechanism 106, the mechanism may be placed remote from the bearer 94 and a connecting rod 128 utilized to transfer the adjustment from the mechanism 106 to the bearer 94.

The following is an example of the use of a differential pressure for placing the plate cylinder in a "removal" position. As depicted in FIG. 5A, the air cylinder 84 is supplied with air at 50 psi from a source 300 through lines 302 and 304 having valves 306 and 308, respectively. An upper chamber 310 is supplied by line 302 and a lower chamber 312 is supplied by line 304. In a "closed" position, the valve connects the chamber to the atmosphere and in an "open" position the valve connects the chamber to the source.

For the "removal" position valve 306 is closed and valve 308 is opened allowing the piston 314 to move fully upward releasing the bearer disc 90. The plate cylinder may now be removed from the printing station.

After insertion of a new plate cylinder, valve 306 is opened. If for example, the upper chamber 310 has 3 square inches of area and the lower chamber 312 has 2 square inches of area, then 150 pounds of force is developed in the upper chamber 310 and 100 pounds of force in the lower chamber 312 resulting in a differential pressure applied by piston 314 to the bearer disc 90 of 50 pounds of force. The spring 316 (springs 116 and 118 in FIG. 5) is designed to apply an opposed force of 75 pounds thereby causing the plate cylinder to be in the "stand by" position.

To place the plate cylinder in the "print" position valve 308 is closed, placing the full 150 pound of force on the piston 314 and the bearer disc 90. Since the spring pressure is only 75 pounds, the springs of the adjusting mechanisms on the bearers compress until the bearers are in their prior set adjusted position as determined by the setting of the adjusting mechanisms.

As explained, the plate cylinder may be moved to a standby position or removed from the printing station without affecting the adjustments of the rolls in the printing station.

The impression roll 60 is part of a sub-assembly which also holds the idler roll 62. This sub-assembly is attached to the frame of the printing station by bolts or screws. When the air cylinders 84 fully retract the pistons 86, it can be appreciated that the plate cylinder 58 may be lifted off and removed from the printing station. It is important to note that in doing so, the adjustment of the bearers 92 and 94 does not change so that a new plate cylinder 58 may be inserted without having to readjust the printing station. This feature is not found in the prior art. Furthermore, the changing of plate cylinders is quick and can be done within a matter of seconds if necessary.

As will be explained later, it is also possible to remove the anilox roll 56, as well as the doctor roll 54 without the use of any tools. Special mechanisms are provided which provide for quick removal of these rolls within a matter of seconds. Furthermore, the adjustment of the bearer 94 associated with the anilox roll 56 is not disturbed by removal of the anilox roll 56, as well as, the adjustment of the doctor roll 54, which will be described below.

Figure 7:
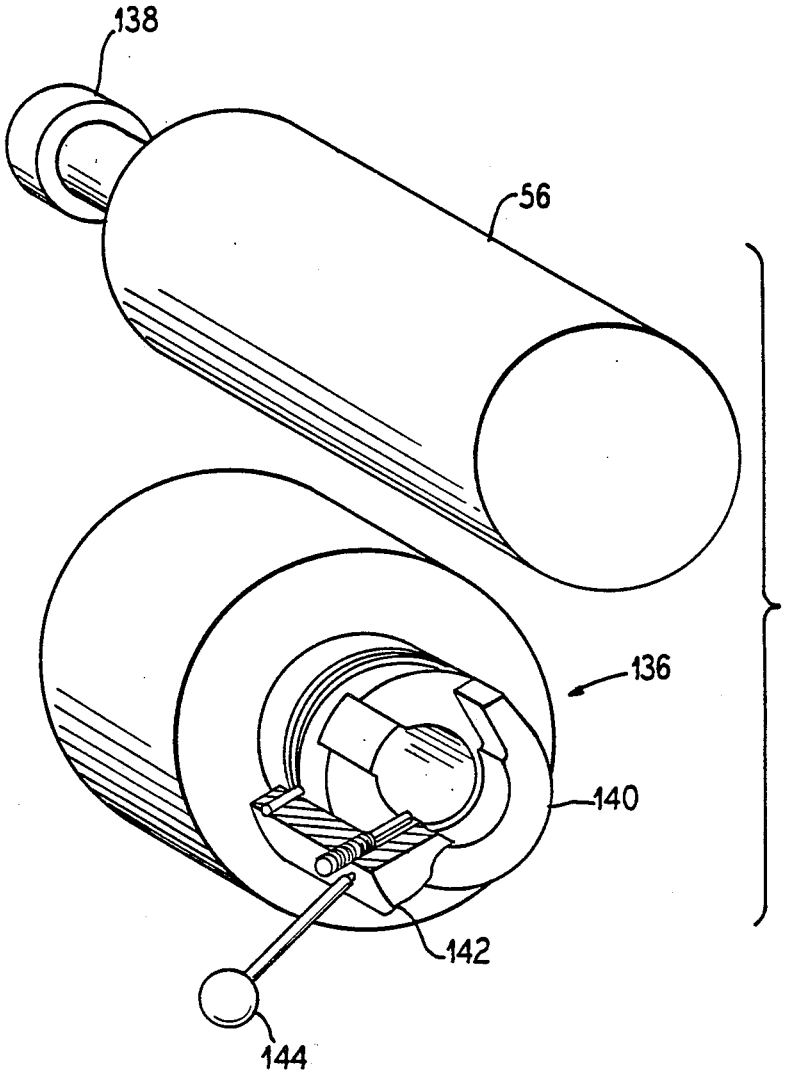
FIG. 7 is a perspective view of the anilox roll and its quick installation support mechanism.
Figure 8:
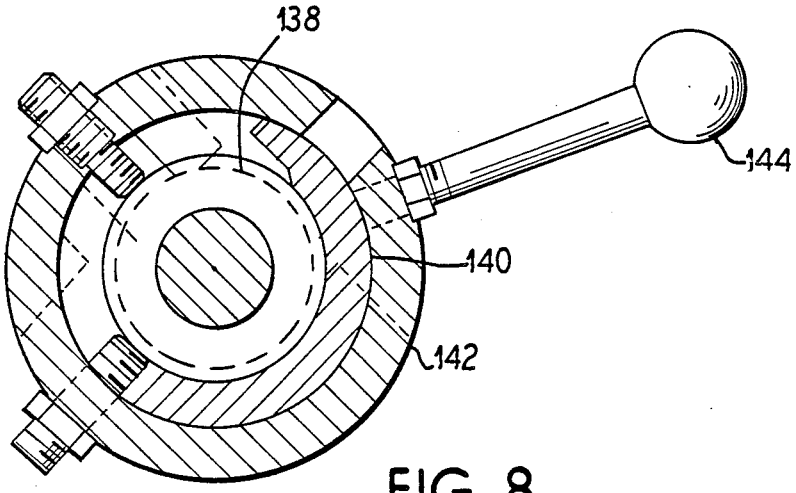
FIGS. 8 and 9 are cross-sectional side views of the anilox roll quick installation support mechanism.
Figure 9:
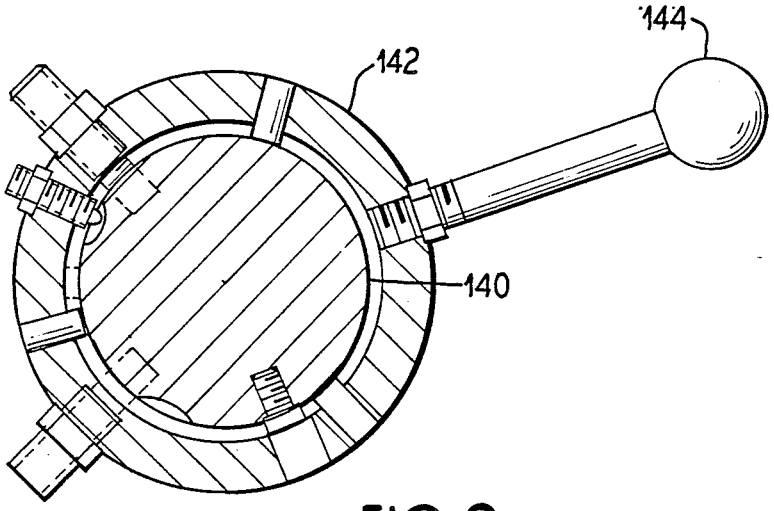

FIGS. 7, 8 and 9 show in further detail, the anilox roll quick installation support 136. On each end of the anilox roll 56, is an anilox roll bearing 138. The anilox roll bearing 138 fits in an anilox roll bearing rest 140 on the support 136. The rest 140 is substantially U-shaped as shown. Closing section 142 rotates by means of handle 144 after the anilox roll bearing 138 is inserted into the rest 140 to lock the anilox roll 156 in position. The closing section 142 may be locked in place in the closed position by any appropriate means. It is important to note that by utilizing this approach the support 136 is separate and does not effect the positioning of the bearer 94. Therefore, the anilox roll 56 can be removed and replaced without the need for readjusting the printing station.

Figure 10:
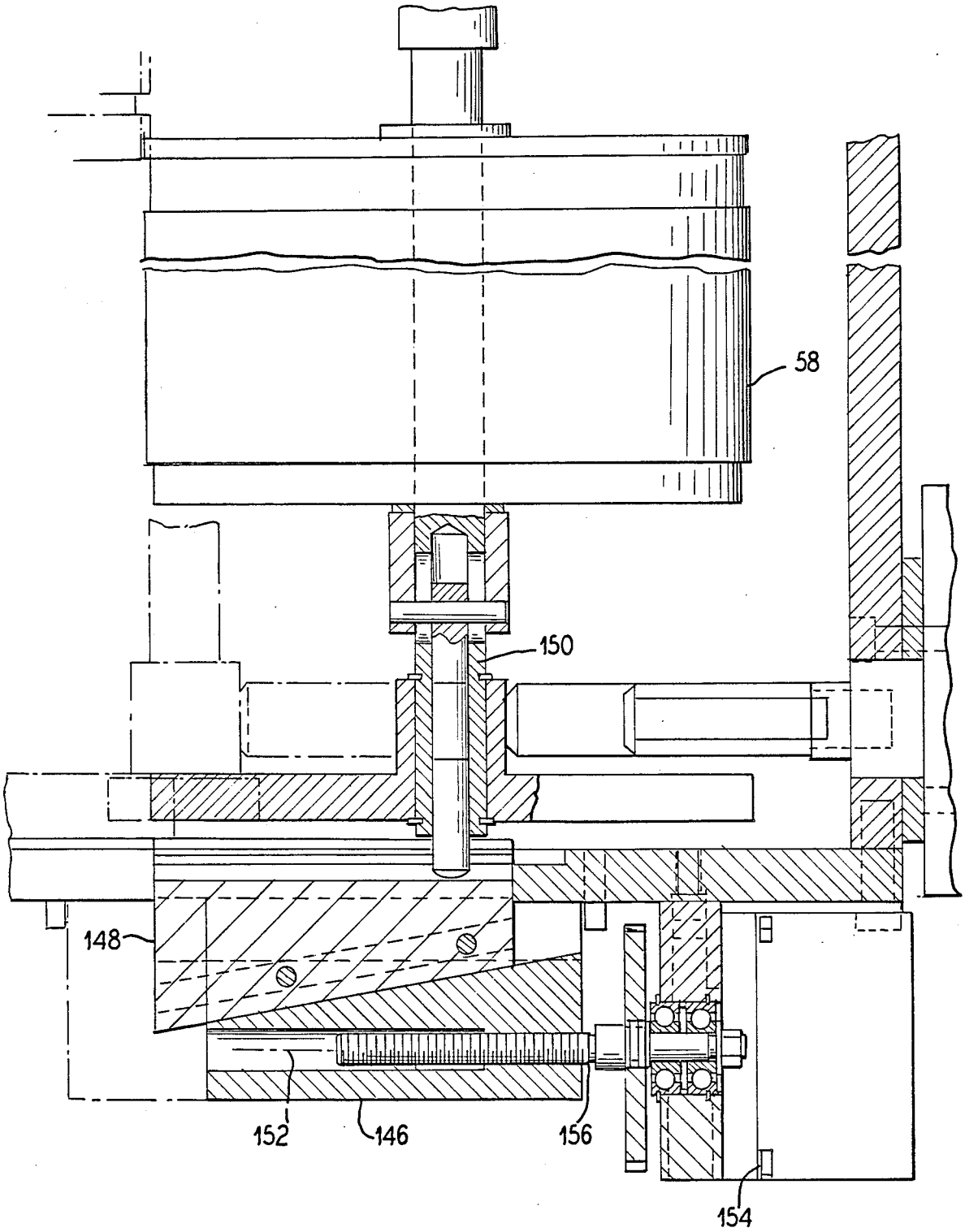
FIG. 10 is a cross-sectional top view of the adjusting mechanism for different plate cylinder sizes.

In addition to the previous adjustments, basically adjustments for skew of the rolls, the printing station also provides a mechanism for lateral adjustment of the plate cylinder 58 without interferring with the quick removal ability of the printing station. This is provided as shown in FIG. 10, by the mechanism comprising two ramp shaped components 146 and 148. The shaft 150 of the plate cylinder 58 engages the section 148 as the section 146 is moved relative to the section 148 along axis 152 in an axial direction. It causes the section 148 to move in a direction perpendicular to the axis 152 thereby providing lateral adjustment of the plate cylinder 58. The movement of the section 146 may be effected by any appropriate means such as by motor 154 connected through an appropriate gearing on shaft 156.

Figure 11:
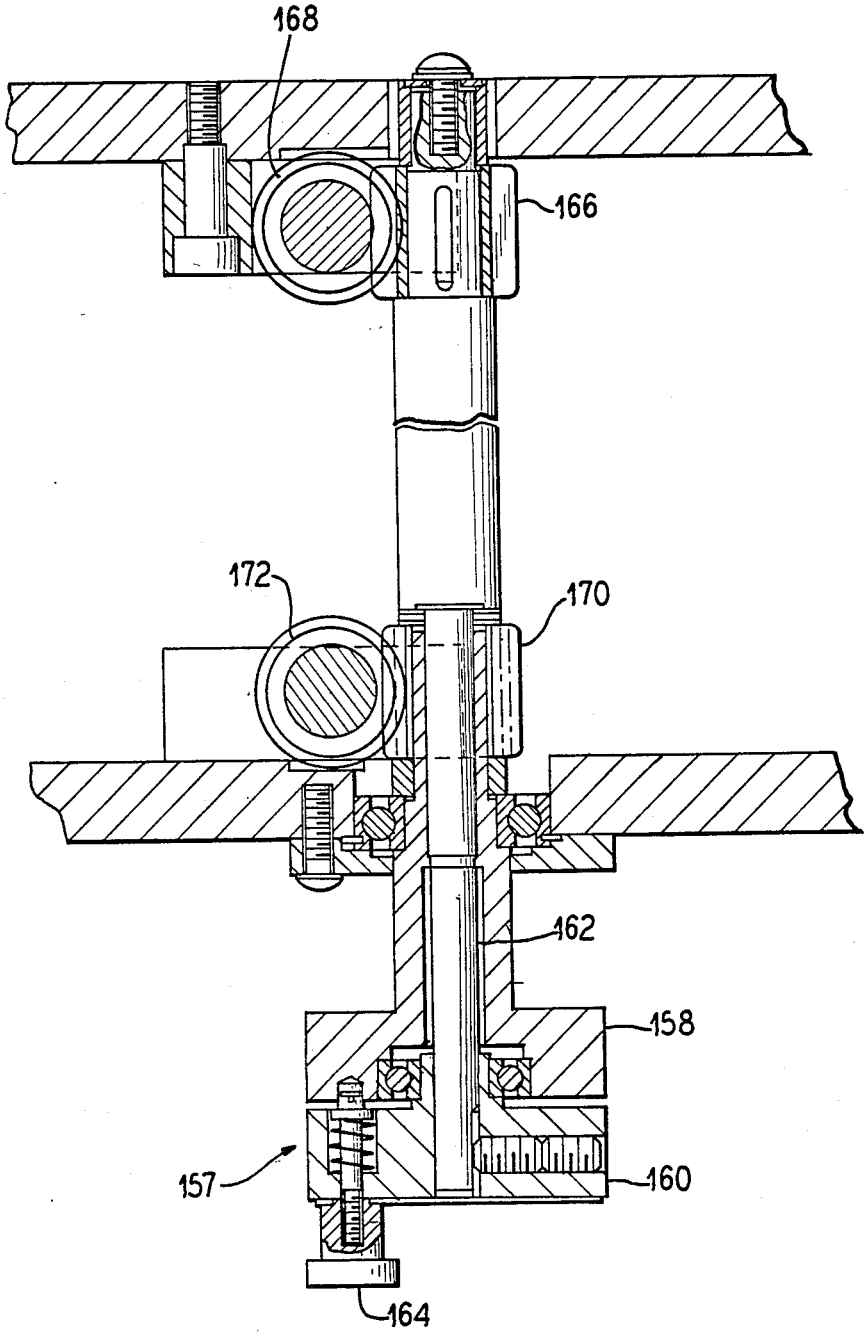
FIG. 11 is a cross-sectional top view of the adjusting mechanism for use with the bearers in the printing station.
Figure 12:
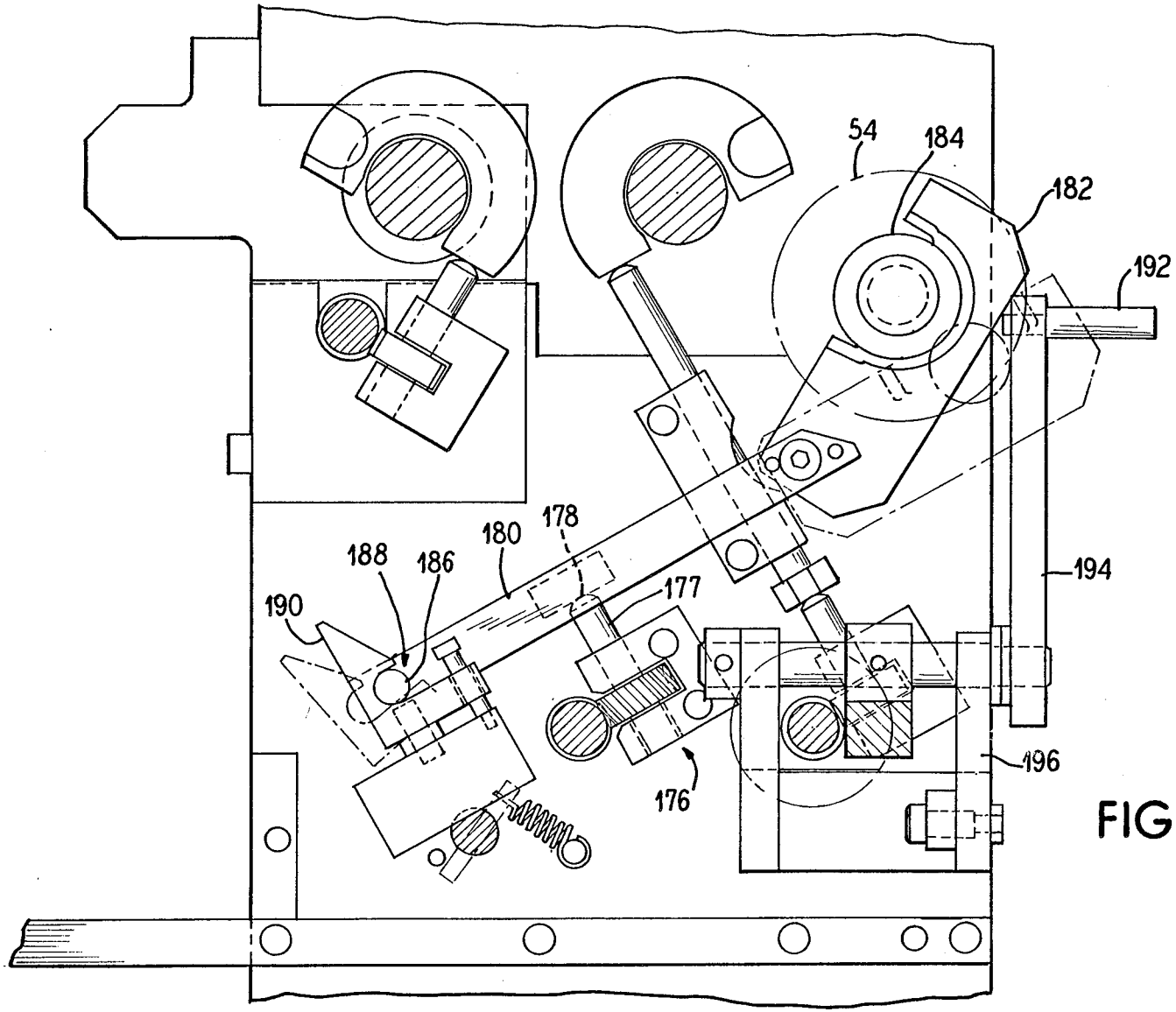
FIG. 12 is an end view of the mechanism for the quick release of the doctor roll and the lift-off mechanism for an ink pan used in the printing station.
Figure 13:
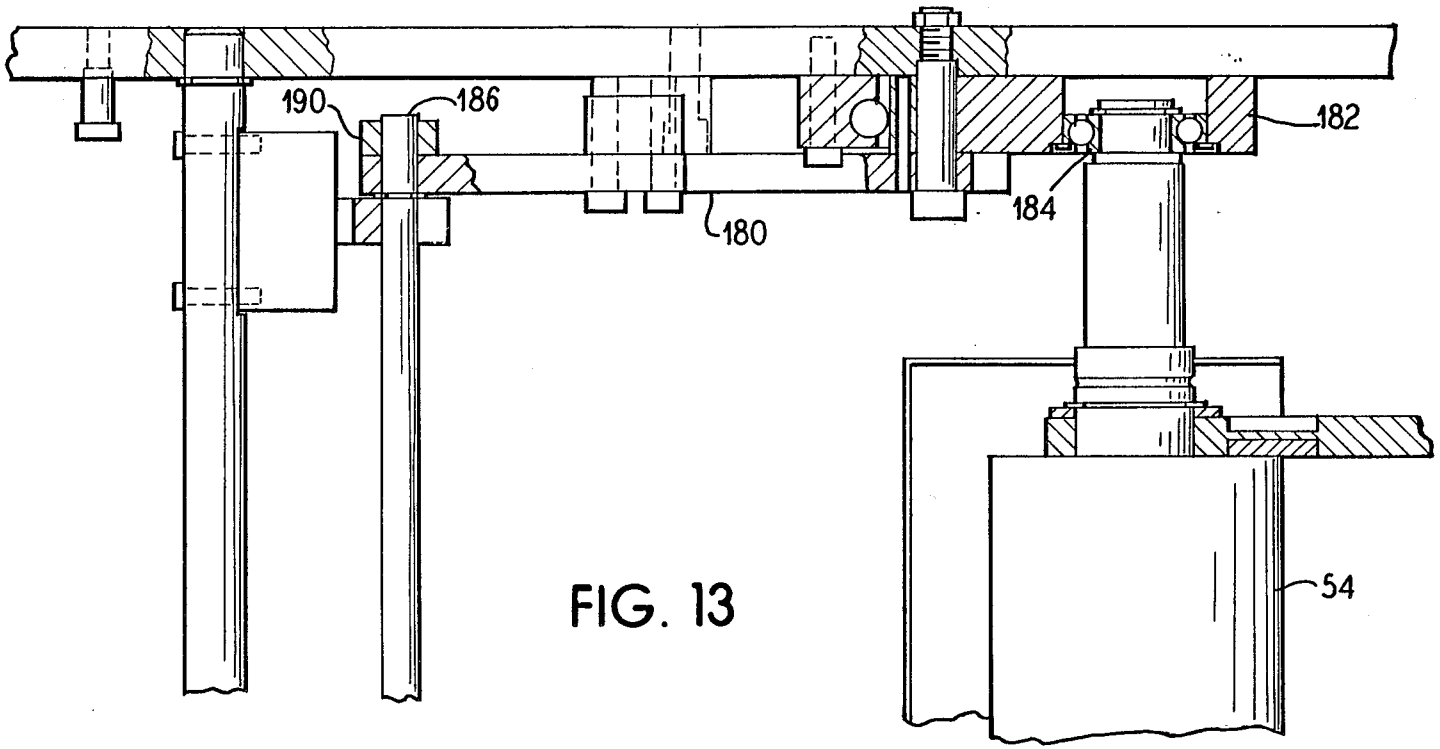
FIG. 13 is a cross-sectional side view of the FIG. 12 mechanism.
Figure 14:
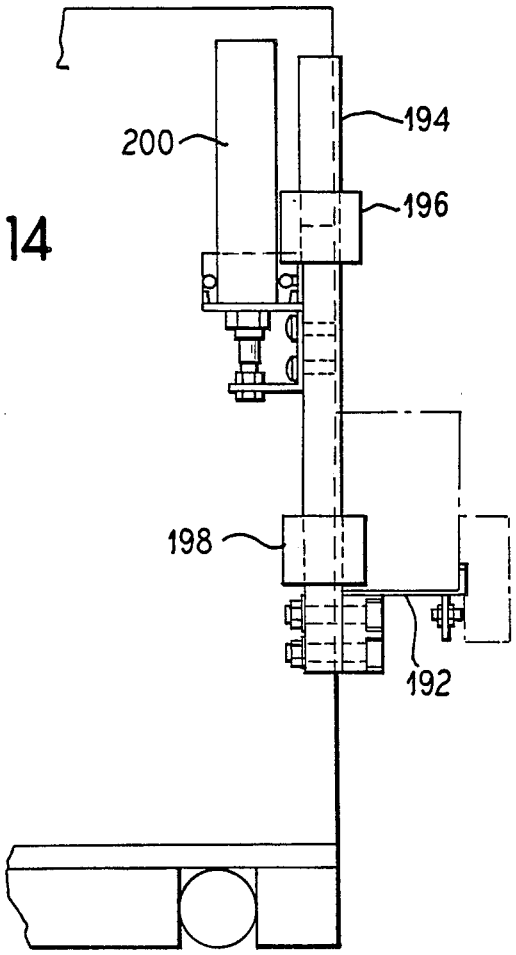
FIG. 14 is an end view of the lift-off ink pan mechanism.
Figure 15:
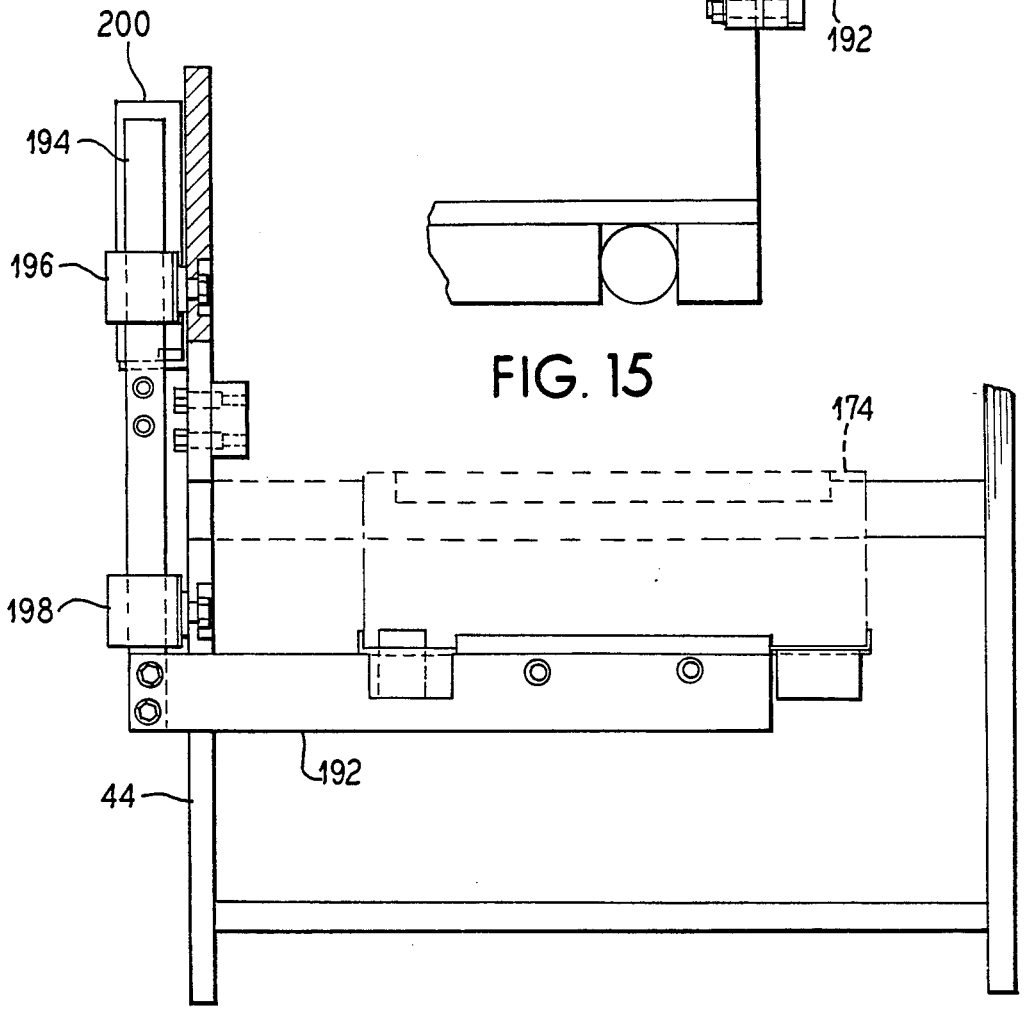
FIG. 15 is a side view of the lift-off ink pan mechanism.
Figure 16:
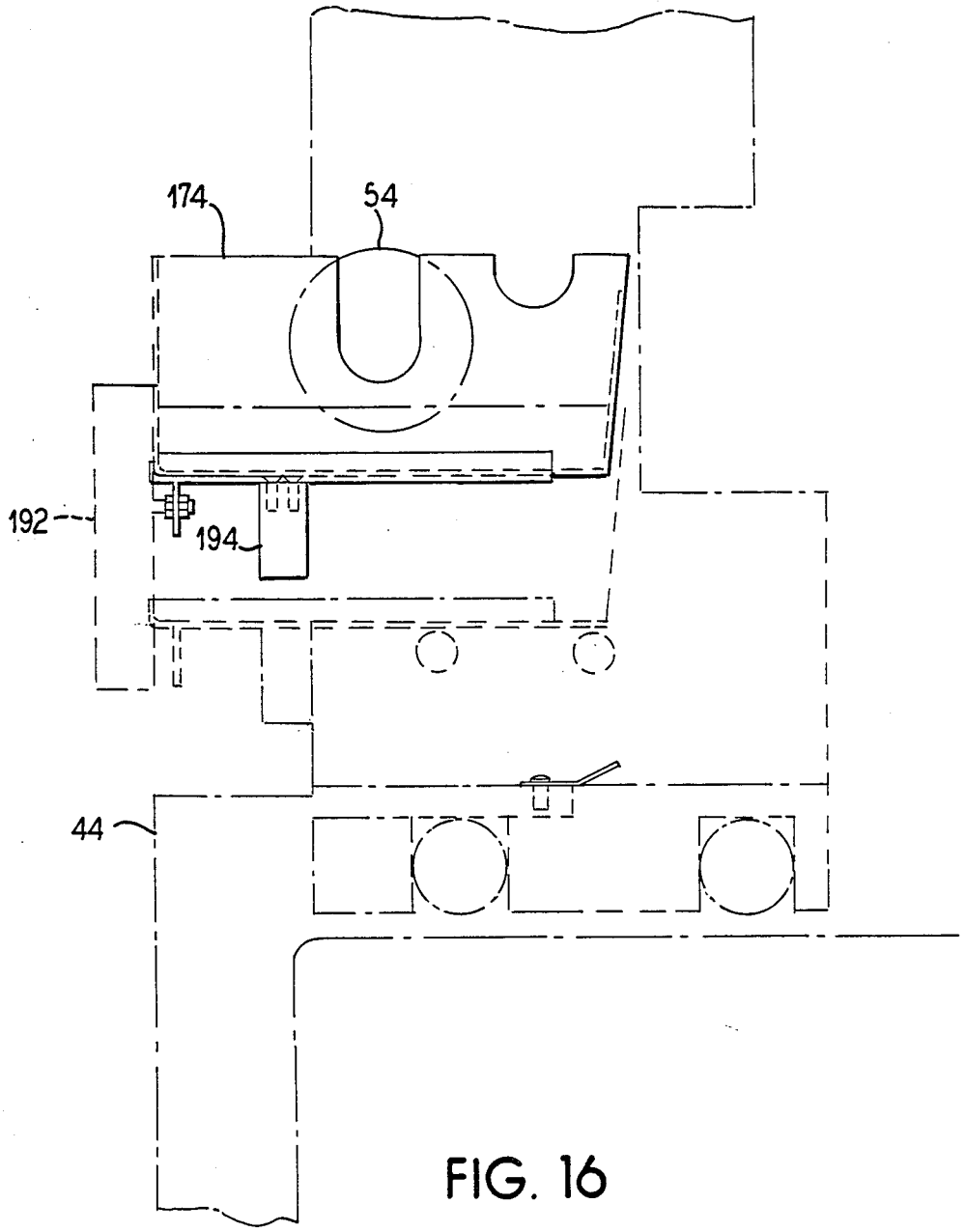
FIG. 16 is another end view of the lift-off ink pan mechanism.

The novel printing station also provides for appropriate control of the adjustment mechanism 64, 66 and 68, one of which, the control 157 for mechanism 64, is shown in FIG. 11, for adjusting the skew on one of the rolls of the impression roll 60, the anilox roll 56 or the doctor roll 54. As shown in FIG. 11, the control 157 has a first knob 158 and a second knob 160 positioned on a common shaft 162. Knob 164 provides the ability to lock knobs 158 and 160 together so that they may be turned in unison. Alternatively, the knobs 158 and 160 may be adjusted independently. Knob 160 turns shaft 162 which extends from front to the back of the printing station and turns gear 166 which meshes with worm gear 168. Similarly, knob 158 operates gear 170 which meshes with worm gear 172 on the front of the printing station. The worm gears 168 and 172 form part of the adjustment mechanisms, such as 104 and 106 shown in FIG. 5 and explained above. Thus, the printing station allows for adjustment of the impression roll 60, the anilox roll 56 and the doctor roll 54.

FIGS. 12 through 20 depict the mechanism for the quick removal of the doctor roll 58, as well as, the lifting mechanism for ink pan 174.

The adjusting mechanism 176 operates similar to the adjusting mechanisms 104 and 106 with the exception that the adjusting mechanism 176 does not utilize a spring around its shaft 177. At an end 178 the shaft 177 contacts an arm 180. At one end of the arm 180 a doctor roll bearing support 182 is attached and is substantially U-shaped. The doctor roll bearing 184 connected to an end of the doctor roll 54 fits into the doctor roll bearing support 182. At the opposed end of the arm 180, a pin 186 is attached and fits into a U-shaped aperture 188 in a latch 190. When the latch 190 is released, the arm 180 allows the doctor roll bearing support 182 to move from the first position shown in FIG. 12 to the second position shown in phantom lines in FIG. 12. This allows the doctor roll 54 to be lifted out of the doctor roll bearing support 182. It should be noted that the adjusting mechanism 176 is uneffected by this movement and, thus, a replacement doctor roll could be reinserted and placed back into position without requiring readjustment of the printing station.

The pan lifting mechanism has a bracket 192 for supporting the ink pan 174. The bracket 192 is attached to one end of a square bar 194, the other end of which is attached to support 196. As can be more clearly seen in FIGS. 14 through 16, the square bar 194 rides in two square bearings 196 and 198. An air cylinder 200 is attached to the square bar 194 such that it may move in an up and down direction in the square bearings 196 and 198. After the doctor roll 54 is installed in the doctor roll bearing support 182 and placed in operating position, the ink pan 174 can be raised by means of the square bar 194 and support 192 such that the ink may be applied to the doctor roll 54.

Figure 17:
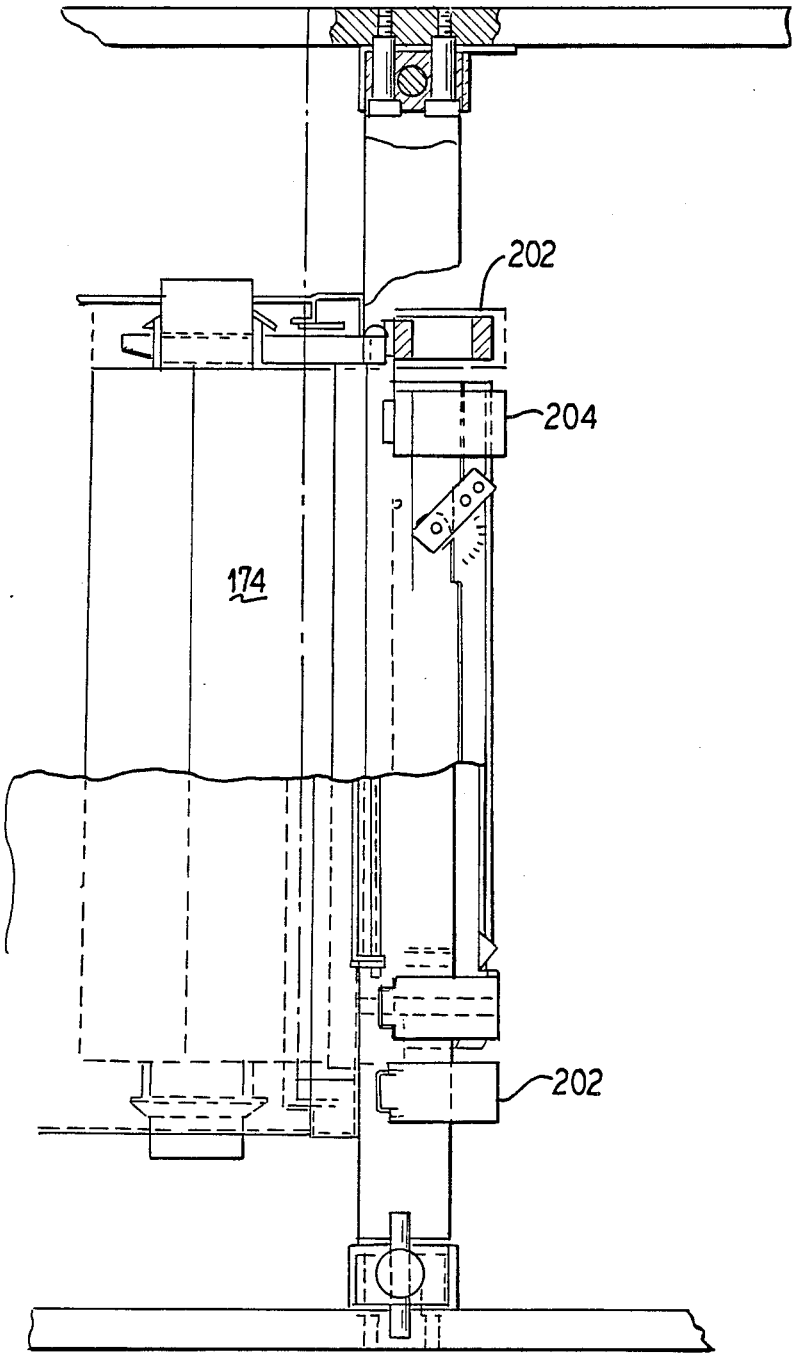
FIG. 17 is a side view of the ink pan with mounted doctor blades.
Figure 18:
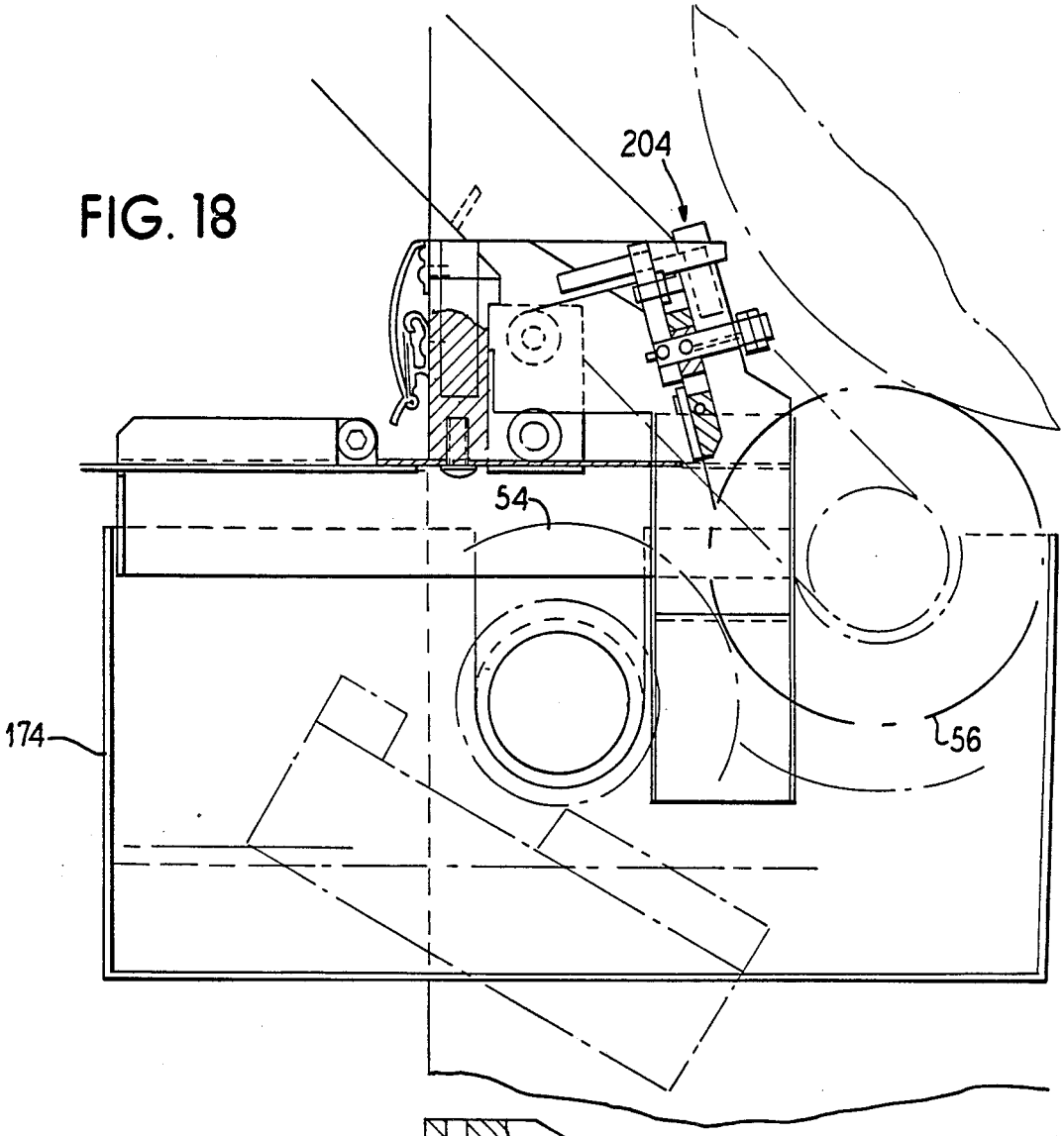
FIG. 18 is an end view of the ink pan with mounted doctor blades.
Figure 19:
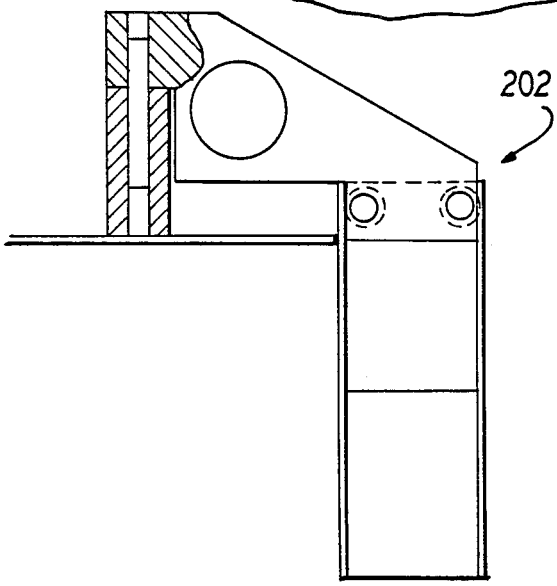
FIG. 19 is a side view of an end wiper.
Figure 20:
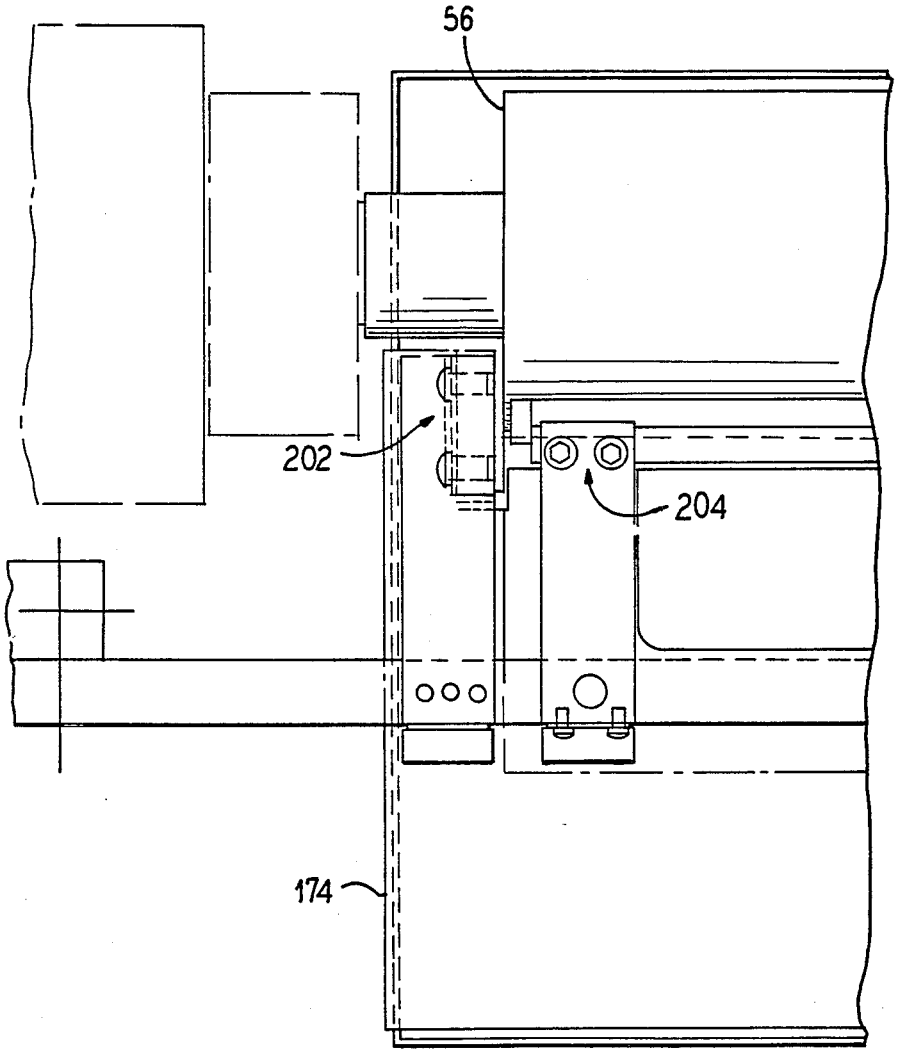
FIG. 20 is a top view of the ink pan with mounted doctor blades.

As shown in FIGS. 17, 18 and 19, a side or end doctor blade 202 may be attached to the ink pan and ink pan lifting assembly, as well as, a lateral doctor blade 204. In the preferred embodiment, the end doctor blades 202 and the lateral doctor blade 204 are clipped onto the ink pan 174 or ink lifting mechanism to provide for easy removal without the use of tools. As can be seen in FIG. 18, the lateral doctor blade 204 rides against the face of the anilox roll 56 and the end wiper 202 ride against the ends of the anilox roll 56.

Referring now back to FIG. 2, and having an understanding of the advantages of the quick interchangability of the plate cylinder 58 in the printing station, it can be appreciated that the present invention is especially advantageous when used with two printing stations 210 and 212, wherein the stations alternate in printing. The web 30 proceeds first through station 210 and then subsequently through station 212. Station 210 may print one item on a particular label, and the second station 212 may print a different item on a different label on the same web 30. Thus, for example, labels having already a certain printing or picture may have additional information added to those labels for a short run capacity. For example, 100 labels could be printed with a first item of information, followed by another 100 labels being printed with a second item of information. The advantages of the present invention is that the web does not have to be stopped when the change is made from the printing of the first item to the printing of the second item, nor is there any significant wastage between the two different printings.

This is achieved by first having station 210 begin printing. The automatic counter 214 on station 210 begins counting down from 100, for example. When the counter 214 reaches zero, the station 210 sends a signal to station 212 to set counter 216 to 100 and to cause station 212 to begin printing as soon as the next blank label passes through station 212. This obviously implies there must be the appropriate built in time delay so that the last label printed by station 210 passes station 212 before station 212 begins printing.

While station 212 is printing, an operator may then remove the plate cylinder 218 from station 210 and replace it with a new plate cylinder for printing a third item on the labels. Since it takes only a few seconds for the operator to interchange the plate cylinders and place the station 210 in a stand-by mode, it is possible for the short runs to be printed. After the counter 216 on station 212 reach zero, control is transferred back to station 210 which begins printing with the new plate cylinder. Then the operator moves to station 212 and replaces the plate cylinder 220 with a different plate cylinder for printing a fourth item on the labels in a similar manner as explained above.

Thus, the two print stations 210 and 212 can alternate and print very short runs without wastage and without stopping the web, while the operator continually changes the plate cylinders in the stations. This has hereto for not been possible with the prior art type printing stations in which the plate cylinder had to be bolted in place and, even if it could be removed quickly, the rolls in the station had to be readjusted when the new plate cylinder was inserted. This long delay time resulting in a need to stop the movement of the web to avoid large amounts of waste. Of course, in stopping and restarting the web, there is still a certain substantial amount of waste incurred.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. A printing station for use in a printing press comprising:

support means for providing a frame;

first means on said support means for holding an impression roll;

second means on said support means for holding an anilox roll;

first adjustable means on said support means for positioning a plate cylinder relative to said impression roll;

second adjustable means on said support means for positioning said plate cylinder relative to said anilox roll;

releasable means for retaining said plate cylinder in a predetermined position relative to said impression roll and said anilox roll, said releasable means operable to allow removal and insertion of said plate cylinder without changing a setting of said first and second adjustable means;

each of said first and second adjustable means having an adjustable mechanism and a bearer having a pivot end attached to said support means and a free end, said bearer having at least a curved surface for contacting an end region of said plate cylinder, said adjustable mechanism having a moveable member contacting said free end of said bearer, wherein said moveable member causes said free end of said bearer to move pivoting said bearer about said pivot end thereby adjusting the position of said plate cylinder;

said bearer also having an aperture in its free end within which a stationary pin is located, said pin being connected to said support means, said pin and aperture providing a predetermined gap therebetween.

2. The printing station according to claim 1 wherein each of said first and second adjustable means has a means for applying a first total effective vector force to said plate cylinder and wherein said releasable means for retaining said plate cylinder applies a second variable opposed vector force with a first predetermined magnitude to said plate cylinder, said first force being less than said second force to place said plate cylinder in a printing position.

3. The printing station according to claim 2 wherein said releasable means further applying said second force with a second predetermined magnitude to said plate cylinder, said second force being less than said first force to place said plate cylinder in a stand-by position.

4. The printing station according to claim 3 wherein each of said first and second adjustable means comprises an adjustable mechanism effective when said plate cylinder is in said printing position and has a fixed stop effective when said plate cylinder is in said stand-by position.

5. The printing station according to claim 1 wherein each of said plate cylinder, impression roll and anilox roll have first and second ends positioned at front and back ends of said support means, and wherein each of said first and second means for holding includes substantially similar front and back means for holding on each end of said respective rolls, and wherein each of said first and second adjustable means includes substantially similar front and back adjustable means on each end of said respective rolls, and wherein said releasable means retains said plate cylinder at both said first and second ends of said plate cylinder.

6. The printing station according to claim 5 said printing station further comprising means for controlling said front adjustable means and its associated back adjustable means, said means for controlling having a front controller for changing said front adjustable means and a back controller for changing said back adjustable means, said front and back controllers positioned adjacent one another, said means for controlling further having means for locking said front controller to said back controller.

7. The printing station according to claim 1 wherein said adjustable mechanism has means for providing a first force of predetermined magnitude against said free end of said bearer, said releasable means contacting said end region of said plate cylinder resulting in a second force substantially opposed to said first force to be applied against said curved surface of said bearer, and wherein, when said second force is greater than said first force, said free end of said bearer moves down and contacts said moveable member of said adjustable mechanism and, when said first force is greater than said second force, said bearer moves up and a wall of said aperture contacts said stationary pin.

8. The printing station according to claim 1 wherein said end region of said plate cylinder has a substantially disc shaped component for contacting said curved surface of said bearer.

9. The printing station according to claim 1 wherein said second means for holding said anilox roll comprises two manual quick release mechanisms for securing each end of said anilox roll.

10. The printing station according to claim 9 wherein each of said manual quick release mechanisms has a substantially U-shaped support attached to said support means for holding an end of said anilox roll and a rotatable substantially U-shaped element attached to said U-shaped support for releasably locking said end of said anilox roll.

11. The printing station according to claim 1 wherein said releasable means for retaining said plate cylinder comprises:

at least one compressed air cylinder having top and bottom ports with a piston contained therein defining top and bottom chambers associated with said top and bottom ports, respectively;

means for connecting said piston to an end region of said plate cylinder;

a source of compressed air;

first and second air supply lines in series with first and second valves, respectively, connected between said source of compressed air and said top and bottom ports, respectively, each of said first and second valves having means for connecting said associated port to said source of compressed air and having means for venting said associated port to the atmosphere; and means for controlling said first and second valves.

12. The printing station according to claim 11 wherein said plate cylinder has two opposed end regions, and wherein said printing station further has at least two compressed air cylinders and associated means for connecting said pistons contained in said respective compressed air cylinders to a respective end region of said plate cylinder.

13. A printing station for use in a printing press comprising:

support means for providing a frame;

first means on said support means for holding an impression roll;

second means on said support means for holding an anilox roll;

first adjustable means on said support means for positioning a plate cylinder relative to said impression roll;

second adjustable means on said support means for positioning said plate cylinder relative to said anilox roll;

releasable means for retaining said plate cylinder in a predetermined position relative to said impression roll and said anilox roll, said releasable means operable to allow removal and insertion of said plate cylinder without changing a setting of said first and second adjustable means;

each of said first and second adjustable means having an adjustable mechanism and a bearer having a pivot end attached to said support means and a free end, said bearer having at least a curved surface for contacting an end region of said plate cylinder, said adjustable mechanism having a moveable member contacting said free end of said bearer, wherein said moveable member causes said free end of said bearer to move pivoting said bearer about said pivot end thereby adjusting the position of said plate cylinder;

said end region of said plate cylinder having a substantially disc shaped component for contacting said curved surface of said bearer;

said diameter of said disc shaped component being substantially the same as the diameter of a mid-portion of said plate cylinder.

14. The printing station according to claim 13 wherein said printing station utilizes any one of a plurality of plate cylinders having different diameters.

15. A printing station for use in a printing press comprising:

support means for providing a frame;

first means on said support means for holding an impression roll;

second means on said support means for holding an anilox roll;

first adjustable means on said support means for positioning a plate cylinder relative to said impression roll;

second adjustable means on said support means for positioning said plate cylinder relative to said anilox roll;

releasable means for retaining said plate cylinder in a predetermined position relative to said impression roll and said anilox roll, said releasable means operable to allow removal and insertion of said plate cylinder without changing a setting of said first and second adjustable means;

said printing station further having third means on said support means for holding a doctor roll, and third adjustable means on said support means for positioning said doctor roll relative to said anilox roll;

said third means for holding said doctor roll having two means for moving said doctor roll away from said anilox roll located on either end of said doctor roll; and said means for moving having an arm with a substantially U-shaped support on a first end thereof for supporting an end of said doctor roll and a latch mechanism on a second end thereof for locking said means for moving when said doctor roll is positioned relative to said anilox roll.

16. A printing station for use in a printing press comprising:

support means for providing a frame;

first means on said support means for holding an impression roll;

second means on said support means for holding an anilox roll;

first adjustable means on said support means for positioning a plate cylinder relative to said impression roll;

second adjustable means on said support means for positioning said plate cylinder relative to said anilox roll;

releasable means for retaining said plate cylinder in a predetermined position relative to said impression roll and said anilox roll, said releasable means operable to allow removal and insertion of said plate cylinder without changing a setting of said first and second adjustable means;

third means on said support means for holding a doctor roll, and third adjustable means on said support means for positioning said doctor roll relative to said anilox roll;

means for supporting an ink pan under said doctor roll;

means for moving said ink pan away from said doctor roll, said means for moving said ink pan connected to said support means;

said means for moving said ink pan having a frame for supporting said ink pan, said frame having a pair of upright members, each of said members slideably positioned in at least two bearings, and means for sliding said upright member in said bearings, said means for sliding connected to said upright member.

17. The printing station according to claim 16 wherein said means for sliding comprising an air cylinder attached to said support means and having a piston rod connected to at least one of said upright members, and means for controlling said air cylinder.

18. The printing station according to claim 16 wherein said upright members have a non-circular cross-sectional configuration and said bearings have a substantially matching configuration to said upright members.

19. The printing station according to claim 18 wherein said cross-sectional configuration is substantially square.

20. An alternating printing station system for use in printing press comprising:

first and second printing stations having a continuous web with a plurality of substrates thereon moving first through said first printing station and then through said second printing station, each of said first and second printing stations having;

support means for providing a frame;

first means on said support means for holding an impression roll;

second means on said support means for holding an anilox roll;

first adjustable means on said support means for positioning a plate cylinder relative to said impression roll;

second adjustable means on said support means for positioning said plate cylinder relative to said anilox roll;

releasable means for retaining said plate cylinder in a predetermined position relative to said impression roll and said anilox roll, said releasable means operable to allow removal and insertion of said plate cylinder without changing a setting of said first and second adjustable means;

means for counting said substrates on said web as said web moves through said printing station;

means for controlling said releasable means in response to said means for counting, said means for controlling, when said means for counting reaches a predetermined number, providing a first control signal to cause said releasable means to effect movement of said plate cylinder from a printing position to a stand-by position, and said means for controlling providing a second signal; and said first and second printing stations alternately placing their associated plate cylinders in said printing position, one of said printing stations placing said plate cylinder in said stand-by position when its means for counting reaches said predetermined number, said second signal being sent to said other printing station which thereafter places its print cylinder in said printing position;

each of said first and second adjustable means having an adjustable mechanism and a bearer having a pivot end attached to said support means and a free end, said bearer having a least a curved surface for contacting an end region of said plate cylinder, said adjustable mechanism having a moveable member contacting said free end of said bearer, wherein said moveable member causes said free end of said bearer to move, pivoting said bearer about said pivot end thereby adjusting the position of said plate cylinder;

said bearer also having an aperture in its free end within which a stationary pin is located, said pin being connected to said support means, said pin and aperture providing a predetermined gap therebetween.

21. The alternating printing station according to claim 20 wherein said second printing station has means for timing to delay placing its print cylinder in said printing position until a last substrate printed upon by said first print station passes through said second print station.

22. Each of the printing stations according to claim 20 wherein each of said first and second adjustable means has a means for applying a first total effective vector force to said plate cylinder and wherein said releasable means for retaining said plate cylinder applies a second variable opposed vector force with a first predetermined magnitude to said plate cylinder, said first force being less than said second force to place said plate cylinder in a printing position.

23. Each of the printing stations according to claim 22 wherein said releasable means further applying said second force with a second predetermined magnitude to said plate cylinder, said second force being less than said first force to place said plate cylinder in a stand-by position.

24. Each of the printing stations according to claim 23 wherein each of said first and second adjustable means comprises an adjustable mechanism effective when said plate cylinder is in said printing position and has a fixed stop effective when said plate cylinder is in said stand-by position.

25. Each of the printing stations according to claim 20 wherein each of said plate cylinder, impression roll and anilox roll have first and second ends positioned at front and back ends of said support means, and wherein each of said first and second means for holding includes substantially similar front and back means for holding on each end of said respective rolls, and wherein each of said first and second adjustable means includes substantially similar front and back adjustable means on each end of said respective rolls, and wherein said releasable means retains said plate cylinder at both said first and second ends of said plate cylinder.

26. Each of the printing stations according to claim 20 wherein each of said first and second adjustable means comprises an adjustable mechanism and a bearer having a pivot end attached to said support means and a free end, said bearer having at least a curved surface for contacting an end region of said plate cylinder, said adjustable mechanism having a moveable member contacting said free end of said bearer, wherein said moveable member causes said free end of said bearer to more, pivoting said bearer about said pivot end thereby adjusting the position of said plate cylinder.

27. Each of the printing stations according to claim 26 wherein said end region of said plate cylinder has a substantially disc shaped component for contacting said curved surface of said bearer.

28. Each of the printing stations according to claim 20 wherein said adjustable mechanism has means for providing a first force of predetermined magnitude against said free end of said bearer, said releasable means contacting said end region of said plate cylinder resulting in a second force substantially opposed to said first force to be applied against said curved surface of said bearer, and wherein, when said second force is greater than said first force, said free end of said bearer moves down and contacts said moveable member of said adjustable mechanism and, when said first force is greater than said second force, said bearer moves up and a wall of said aperture contacts said stationary pin.

29. Each of the printing stations according to claim 20 wherein said releasable means for retaining said plate cylinder comprises:

at least one compressed air cylinder having top and bottom ports with a piston contained therein defining top and bottom chambers associated with said top and bottom ports, respectively;

means for connecting said piston to an end region of said plate cylinder;

a source of compressed air;

first and second air supply lines in series with first and second valves, respectively, connected between said source of compressed air and said top and bottom ports, respectively, each of said first and second valves having means for connecting said associated port to said source of compressed air and having means for venting said associated port to the atmosphere; and means for controlling said first and second valves.

30. Each of the printing stations according to claim 29 wherein said plate cylinder has two opposed end regions, and wherein said printing station further has at least two compressed air cylinders and associated means for connecting said pistons contained in said respective compressed air cylinders to a respective end region of said plate cylinder.

* * * * *